US011034494B2

(12) United States Patent
Nishiaki

(10) Patent No.: US 11,034,494 B2
(45) Date of Patent: Jun. 15, 2021

(54) BOTTLE-SHAPED RESIN CONTAINER

(71) Applicant: NISHIAKI KOUSAKUSHO CO., LTD., Yokohama (JP)

(72) Inventor: Norimichi Nishiaki, Yokohama (JP)

(73) Assignee: NISHIAKI KOUSAKUSHO CO., LTD, Yokohama (JP)

( * ) Notice: Subject to any disclaimer, the term of this patent is extended or adjusted under 35 U.S.C. 154(b) by 97 days.

(21) Appl. No.: 16/364,587

(22) Filed: Mar. 26, 2019

(65) Prior Publication Data

US 2019/0218005 A1 Jul. 18, 2019

Related U.S. Application Data

(62) Division of application No. 14/894,202, filed as application No. PCT/JP2014/052263 on Jan. 31, 2014, now Pat. No. 10,377,544.

(30) Foreign Application Priority Data

Aug. 21, 2013 (JP) ..... JP2013-171442

(51) Int. Cl.
*B65D 1/02* (2006.01)
*B65D 53/02* (2006.01)
(Continued)

(52) U.S. Cl.
CPC ..... *B65D 55/066* (2013.01); *B65D 1/023* (2013.01); *B65D 1/0246* (2013.01); *B65D 41/34* (2013.01); *B65D 53/02* (2013.01)

(58) Field of Classification Search
CPC .. B65D 1/023; B65D 55/066; B65D 41/3428; B65D 1/0246; B65D 1/0238
See application file for complete search history.

(56) References Cited

U.S. PATENT DOCUMENTS 958,887 A 5/1910 Parmele
4,461,389 A 7/1984 Korn
(Continued)

FOREIGN PATENT DOCUMENTS

CN 1187166 A 7/1998
EP 0352962 A1 1/1990
(Continued)

OTHER PUBLICATIONS

Oct. 25, 2019 Extended European Search Report issued in European Patent Application No. 19178631.8.
(Continued)

*Primary Examiner* — Andrew T Kirsch
(74) *Attorney, Agent, or Firm* — Oliff PLC

(57) ABSTRACT

A bottle-shaped resin container with a bottle body and a cap, the container being configured to determine whether the seal has been broken by: the container having a long, tall cylindrical section between a neck ring and a flange that connects the neck ring and the flange; and when the cap body is rotated in the unscrewing direction, bridges being broken and the cap ring separating from the cap body and falling by its own weight so that the lower surface thereof contacts the flange and remains above the flange, exposing the side surface of the long, tall cylindrical-section between the upper surface of the cap ring and the lower surface of the neck ring. As the side surface of the long, tall cylindrical section is a straight line when viewed from the front, it is possible to determine the taper angle definitively and the taper angle is 60-80 degrees.

6 Claims, 14 Drawing Sheets

(51) Int. Cl.
*B65D 55/06* (2006.01)
*B65D 41/34* (2006.01)

(56) References Cited

U.S. PATENT DOCUMENTS

| | | | | |
|---|---|---|---|---|
| 4,613,052 | A | 9/1986 | Gregory et al. | |
| 4,653,657 | A | 3/1987 | Papavasilopoulos | |
| 4,813,561 | A | 3/1989 | Ochs | |
| 5,009,323 | A * | 4/1991 | Montgomery ..... | B65D 41/0414 215/252 |
| 5,638,969 | A | 6/1997 | King | |
| 5,853,097 | A | 12/1998 | Ekkert | |
| 8,353,413 | B2 | 1/2013 | Ekkert | |

FOREIGN PATENT DOCUMENTS

| | | | |
|---|---|---|---|
| JP | S61-273355 | A | 12/1986 |
| JP | H09-58720 | A | 3/1997 |
| JP | 2001-114312 | A | 4/2001 |
| JP | 2002-370760 | A | 12/2002 |
| JP | 2006-264743 | A | 10/2006 |
| JP | 2007-039123 | A | 2/2007 |
| WO | 2007-122324 | A1 | 11/2007 |
| WO | 2009/041188 | A1 | 4/2009 |

OTHER PUBLICATIONS

Feb. 22, 2017 Extended Search Report issued in European Patent Application No. 14838032.2.

Feb. 6, 2018 Office Action issued in European Patent Application No. 14838032.2.

Jul. 11, 2018 Office Action issued in European Patent Application No. 14838032.2.

Mar. 4, 2014 Search Report issued in International Patent Application No. PCT/JP2014/052263.

May 13, 2020 Office Action issued in U.S. Appl. No. 16/364,554.

* cited by examiner

BOTTLE-SHAPED RESIN CONTAINER

TECHNICAL FIELD

The present invention relates to a bottle-shaped resin container typified by a PET bottle.

BACKGROUND ART

A container mentioned in Patent Literature 1 is a representative example of a conventional bottle-shaped resin container.

The bottle-shaped resin container mentioned in Patent Literature 1 will be described with reference to FIGS. 24 and 25.

A bottle-shaped resin container 100 shown in FIG. 24 has a plastic bottle main body 102 and a plastic cap 104.

The bottle main body 102 includes a neck portion 106 and a body portion 108, which are integrally formed. The neck portion 106 has, on its outer periphery, a male threaded portion 110 as well as an annular jaw portion 112 and an annular flange portion 114 each forming a horizontally projecting portion, the male threaded portion, the jaw portion and the flange portion being formed downward from above in this order. The body portion 108 is a container portion which is filled with content such as drinking water.

The cap 104 includes a cap main body 116, a can ring 118, and bridges 120 connecting the cap main body 116 and the cap ring 118 to each other.

The cap main body 116 has a female threaded portion 122 formed on its inner periphery, the female threaded portion 122 being screwed onto the male threaded portion 110. Screwing of the female threaded portion 122 onto the male threaded portion 110 allows the neck portion 106 to be closed by the cap 104.

The cap ring 118 is in a ring shape and its upper end is connected to the lower end of the cap main body 116 via the bridges 120 which arc large in number. The cap ring 118 is formed so as to have a slightly larger internal diameter than the external diameter of the jaw portion 112 so that the cap ring 118 is fitted onto the jaw portion with a slight gar formed outside the jaw portion 112. Inside the cap ring 118, a plurality of stoppers 124 which are capable of engagement with the lower end of the jaw portion 112 from below are formed in a circumferential direction at a predetermined pitch so as to project in a direction toward the axis.

When the cap 104 is screwed onto the neck portion 106 of the bottle main body 102 after the bottle main body 102 is filled with content such as drinking water, the stoppers 124 are configured so that their upper ends are engaged with the lower surface of the jaw portion 112 after the stoppers 124 pass around the jaw portion 112. Then, in discharging the content from the bottle main body 102, the cap main body 116 is rotated in a direction in which the female threaded portion 122 is unscrewed from the male threaded portion 110, whereby the bridges 120 are broken by shear force. Thereafter, further rotation of the cap main body 116 in the same direction causes the cap 101 to be separated from the neck portion 106 and the state is as shown in FIG. 25. In such a state, the lower surface of the cap ring 118 approaches the upper surface of the flange portion 114 and the cap ring 118 is sandwiched between the law portion 112 and the flange portion 114 in a vertically immovable state.

CITATION LIST

Patent Literature

Patent Literature 1: JP 2002-370760 A

SUMMARY OF INVENTION

Technical Problems

Since a conventional bottle-shaped resin container as described in Patent Literature 1 has the above-described configuration, it has been difficult to determine whether the cap is not opened yet or is closed after it is once opened and the container is filled with content again. Further, it is necessary to remove the cap ring 118 for sorting at the time of disposal of the bottle-shaped resin container but it has been difficult to remove the cap ring 118 because the cap ring 118 is sandwiched between the jaw portion 112 and the flange portion 114 and cannot be vertically moved as described above.

The present invention aims at solving the foregoing problems.

More specifically, an object of the present invention is to provide a bottle-shaped resin container capable of easily determining whether the container is not opened, and moreover having a cap ring which can be easily removed.

Solution to Problems

The inventor of the present invention has made an intensive study to solve the foregoing problems and completed the present invention.

The present invention provides the following (1) to (6).

(1) A bottle-shaped resin container comprising:

a bottle main body; and a cap, wherein the bottle main body comprises a neck portion and a body portion which are integrally formed, wherein the neck portion has, on its outer periphery, a male threaded portion as well as an annular jaw portion and an annular flange portion each forming a horizontally projecting portion, the male treaded portion, the jaw portion and the flange portion being formed downward from above in this order, wherein the cap comprises a cap main body, a cap ring, and at least one bridge connecting the cap main body and the cap ring to each other, wherein the cap main body is configured to include a female threaded portion formed on an inner periphery of the cap main body to be screwed onto the male threaded portion such that the female threaded portion is screwed onto the male threaded portion to allow the cap to close the neck portion, wherein the cap ring is in a ring shape, an upper end of the cap ring is connected to a lower end of the cap main body via the at least one bridge, the cap ring is formed to have a larger internal diameter than an external diameter of the jaw portion so that the cap ring is fitted on the jaw portion with a gap formed outside the jaw portion, and at least one stopper capable of engagement with a lower end of the jaw portion from below is formed inside the cap ring so as to project in a direction toward an axis such that when the cap is screwed onto the neck portion after filling the bottle main body with content, an upper end of the at least one stopper is engaged with a lower surface of the jaw portion after the at least one stopper passes around the jaw portion, wherein a high-height cylindrical portion connecting the jaw portion and the flange portion to each other is provided between the jaw portion and the flange portion, wherein the high-height cylindrical portion has a height (H) of 10 to 20 mm, wherein the high-height cylindrical portion has a lateral surface of a linear profile when seen from a front, which allows a taper angle to be determined unambiguously, the taper angle ranging from 60° to 80°, wherein the at least one bridge is formed on an outer peripheral side of the cap ring, and wherein when the cap main body is rotated in a direction in which the female threaded portion is unscrewed from the male threaded portion, thus discharging the content from the bottle main body, the at least one bridge is broken by shear force to separate the cap ring from the cap main body, and as a result the cap ring drops down due to its own weight in a state in which the axis extends in a vertical direction so that its lower surface comes into contact with the flange portion, the cap ring remains on the flange portion and the lateral surface of the high-height cylindrical portion is exposed between an upper surface of the cap ring and the lower surface of the jaw portion, which makes it possible to determine that the cap is already opened.

(2) The bottle-shaped resin container according to (1), wherein a difference (H–h) between the height (H) of the high-height cylindrical portion and a height (h) of the cap ring is at least 3 mm.

(3) The bottle-shaped resin container according to (1) or (2), wherein the height (H) of the high-height cylindrical portion and a height (h) of the cap ring satisfy a relation of $H \geq 1.5 \times h$.

(4) The bottle-shaped resin container according to any one of (1) to (3), wherein the bottle-shaped resin container has a marking which is formed on surfaces of the cap main body and the cap ring so as to lie on both the cap main body and the cap ring in a state in which the cap is not opened, and the cap main body and the cap ring are connected to each other via the at least one bridge, and is configured such that the at least one bridge is broken by cap opening to cause the cap ring to be separated from the cap main body and drop down to come into contact with the flange portion, which makes it possible to determine that the cap is already opened because in a case where the cap is closed again, the marking is not restored to a same state as before the cap opening.

(4) A bottle-shaped resin container comprising:

a bottle main body; and a cap, wherein the bottle main body comprises a nock portion and & body portion which are integrally formed, wherein the neck portion has, on its outer periphery, a male threaded portion as well as an annular jaw portion and an annular flange portion each forming a horizontally projecting portion, the male treaded portion, the jaw portion and the flange portion being formed downward from above in this order, wherein the cap comprises a cap train body, a cap ring, and at least one bridge connecting the cap main body and the cap ring to each other, wherein the cap main body is configured to include a female threaded portion formed on an inner periphery of the cap main body to be screwed onto the male threaded portion such that the female threaded portion is screwed onto the male threaded portion to allow the cap to close the neck portion, wherein the cap ring is in a ring shape, an upper end of the cap ring is connected to a lower end of the cap main body via the at least one bridge, the cap ring is formed to have a larger internal diameter than an external diameter of the jaw portion so that the cap ring is fitted on the jaw portion with a gap formed outside the jaw portion, and at least one stopper capable of engagement with a lower end of the jaw portion from below is formed inside the cap ring so as to project in a direction toward an axis such that when the cap is screwed onto the neck portion after filling the bottle main body with content, an upper end of the at least one stopper is engaged with a lower surface of the jaw portion after the at least one stopper passes around the jaw portion, wherein a nigh-height cylindrical portion connecting the jaw portion and the flange portion to each other is provided between the jaw portion and the flange portion, wherein the high-height cylindrical portion has a height (H) of at least 8 mm, wherein the high-height cylindrical portion has a taper angle of up to 90°, and wherein when the cap main body is rotated in a direction in which the female threaded portion is unscrewed from the male threaded portion, thus discharging the content from the bottle main body, the at least one bridge is broken by shear force to separate the cap ring from the cap main body, and as a result the cap ring drops down due to its own weight in a state in which the axis extends in a vertical direction so that its lower surface comes into contact with the flange portion, the cap ring remains on the flange portion and a lateral surface of the high-height cylindrical portion is exposed between an upper surface of the cap ring and the lower surface of the jaw portion, which makes it possible to determine that the cap is already opened.

(5) The bottle-shaped resin container according to (4), wherein the bottle-shaped resin container has a marking which is formed on surfaces of the cap main body and the cap ring so as to lie on both the cap main body and the cap ring in a state in which the cap is not opened, and the cap main body and the cap ring are connected to each other via the at least one bridge, and is configured such that the at least one bridge is broken by cap opening to cause the cap ring to be separated from the cap main body and drop down to come into contact with the flange portion, which makes in possible to determine that the cap is already opened because an a case where the cap is closed again, the marking is not restored to a same state as before the cap opening.

Advantageous Effects of Invention

The present invention can provide a bottle-shaped resin container capable of easily determining whether the container is not opened, and moreover having a cap ring which can be easily removed.

Since it is easy to determine that the bottle-shaped resin container of the invention as described above is not opened, quality can be easily retained in stores and other places, and for example, poisoning cases can be prevented from occurring. Restaurants which provide products, for example, can make an appeal in that the provided, products are new, thus increasing users' confidence, and users can consume new products safely. Furthermore, efforts made by manufactures toward safety are appreciated and provision of used products or products in refilled containers in restaurants and stores are suppressed, which will lead to an increase in sales volume of products.

Furthermore, since the cap ring of the bottle-shaped resin container according to the invention has a wide range of movement, the cap ring is easily cut out using a tool such as a nipper at the time of sorting. This holds promise for promoting recycling activities.

DESCRIPTION OF EMBODIMENTS

The present invention will be described with reference to FIGS. 1 to 23.

Figure 1:
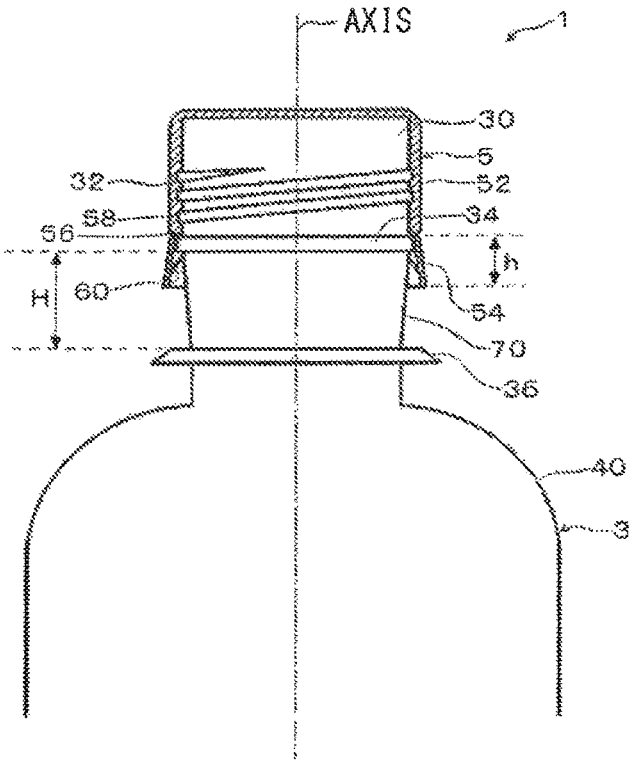
FIG. 1 is a schematic front view (partial cross-sectional view) showing a part of a preferred embodiment of a bottle-shaped resin container according to the invention.

FIG. 1 is a schematic front view (partial cross-sectional view) showing a part of a preferred embodiment of a bottle-shaped resin container according to the invention. The lower part of the bottle-shaped resin container of the invention is not shown in FIG. 1.

In FIG. 1, the bottle-shaped resin container 1 has a bottle main body 3 and a cap 5.

The bottle main body 3 will be described.

The bottle main body 3 includes a neck portion 30 and a body portion 40, which are integrally formed.

The neck portion 30 has on its outer periphery a male threaded Portion 32, an annular jaw portion 34 forming a horizontally projecting portion and an annular flange portion 36 also forming a horizontally projecting portion. The male threaded portion 32, the jaw portion 34 and the flange portion 36 are disposed downward from above in this order.

The body portion 40 of this embodiment is similar to that in a conventionally known container holding content such as drinking water filled thereinto.

The shapes and the materials of the neck portion 30 and the body portion 40 which constitute the bottle main body 3 are not particularly limited and may be the same as those in, for example, conventionally known containers.

The cap 5 will be described.

The cap 5 includes a cap main body 52, a cap ring 54, and bridges 56 connecting the cap main body 52 and the cap ring 54 to each other.

The cap main body 52 has a female threaded portion 58 formed on its inner periphery, the female threaded portion 58 screwed onto the male threaded portion 32. Screwing of the female threaded portion 58 onto the male threaded portion 32 allows the neck portion 30 to be closed by the cap 5.

Figure 2:
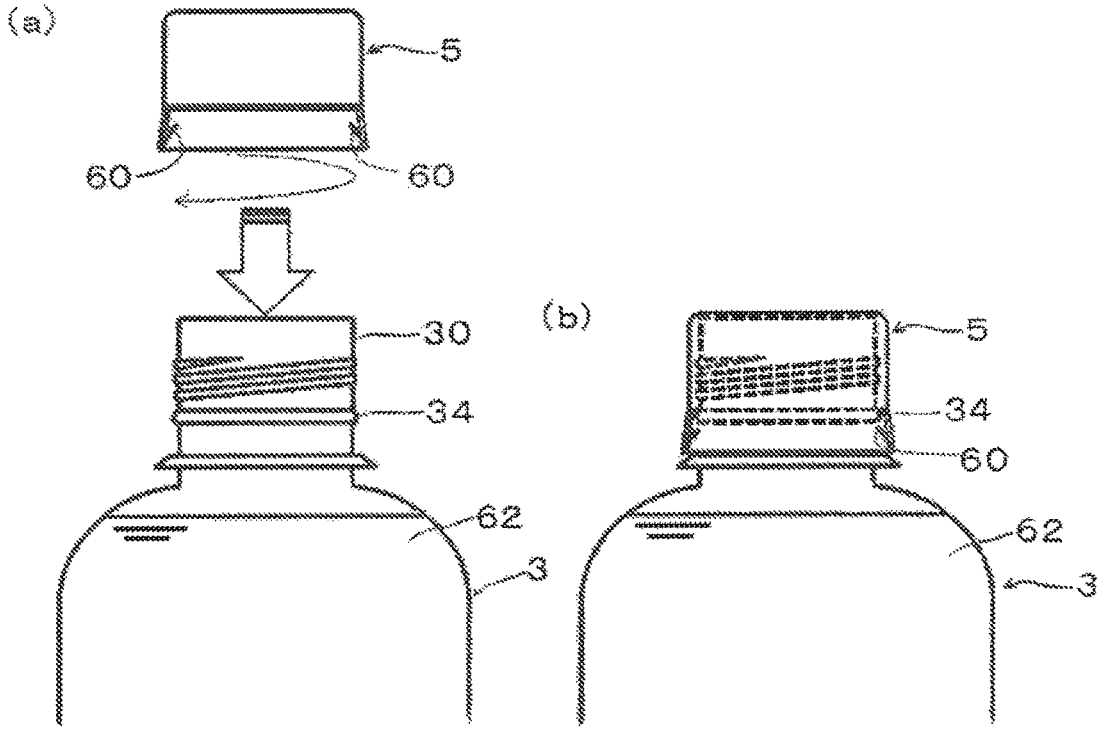
FIG. 2 are schematic front views (partial cross-sectional views) for illustrating screwing of a cap onto a bottle main body.

The cap ring 54 is in a ring shape and its upper end is connected to the lower end of the cap main body 52 via the bridges 56 which are large in number. The cap ring 54 is formed so as to have a slightly larger internal diameter than the external diameter of the jaw portion 34 so that the cap ring 54 is fitted on the outside of the jaw portion 34 with a slight gap formed outside the jaw portion 34. Inside the cap ring 54, at least one stopper 60 which is capable of engagement with the lower end of the jaw portion 34 from below is formed so as to project in a direction toward the axis. When the cap 5 is screwed onto the neck portion 30 of the bottle main body 3 after the bottle main body 3 is filled with content 62 such as drinking water as shown in FIG. 2(*a*), the stopper 60 is configured so that its upper end is engaged with a lower surface of the jaw portion 34 as shown in FIG. 2(*b*) after the stopper 60 passes around the jaw portion 34.

The bottle-shaped resin container of the invention has the above-described configuration and further has a high-height cylindrical portion 70 formed between the jaw portion 34 and the flange portion 35 to connect the jaw portion 34 and the flange portion 36 to each other unlike conventional bottle-shaped resin containers.

Figure 3:
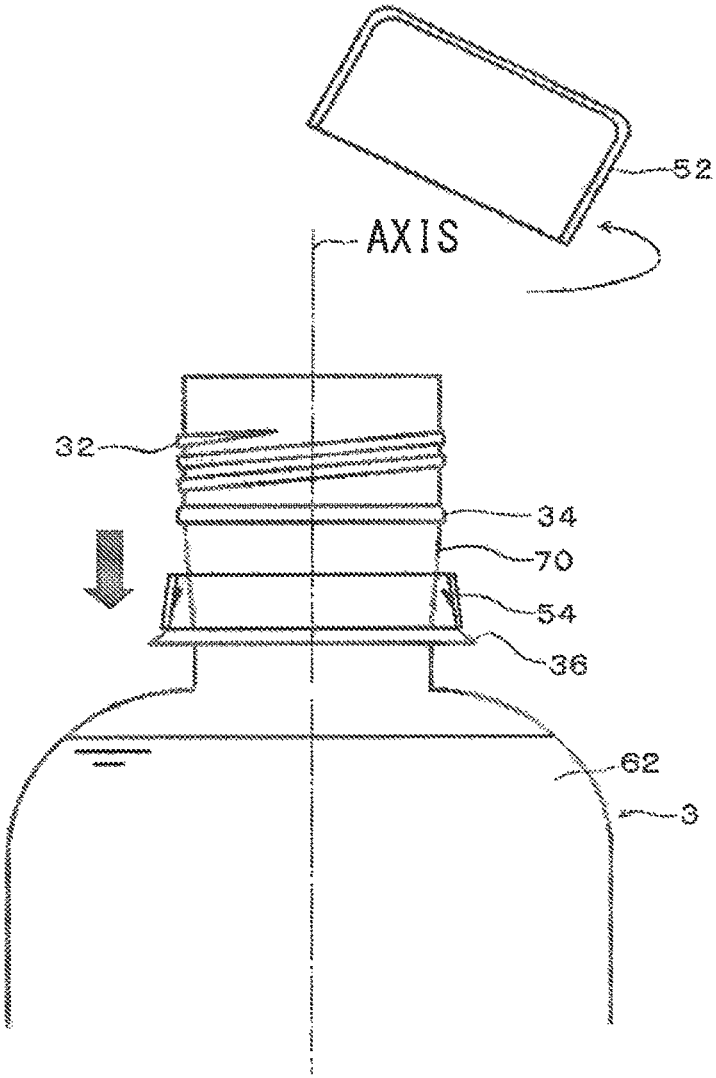
FIG. 3 is a schematic front view (partial cross-sectional view) for illustrating movement of a cap ring.

When the cap main body 52 is rotated, as shown in FIG. 3, in a direction in which the female threaded portion 58 is unscrewed from the male threaded portion 32, thus discharging content 62 such as drinking water from the bottle main body 3 in the bottle-shaped resin container of the invention as described above, the bridges 56 are broken by shear force to separate the cap ring 54 from the cap main body 52. As a result, by putting the bottle-shaped resin container of the invention on a desk or other places so that the axis extends in an approximately vertical direction, the cap ring 54 drops down due to its own weight and its lower surface comes into contact with the flange portion 36 and remains on the flange portion 36. In this state, the lateral surface of the high-height cylindrical portion 70 is exposed between an upper surface of the cap ring 54 and the lower surface of the jaw portion 34 as shown in FIG. 3, which makes it possible to easily determine that the container is already opened.

Figure 4:
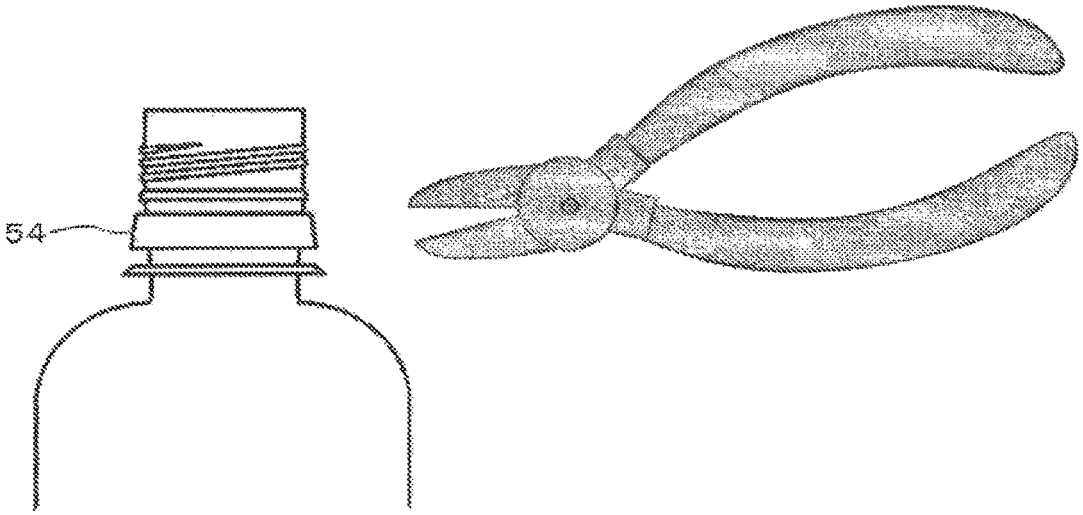
FIG. 4 is a schematic front view for illustrating cutting of the cap ring with a nipper.

Furthermore, since the cap ring 54 of the bottle-shaped resin container of the invention has a wide range of movement as shown in FIG. 4, the cap ring 54 is easily cut out using a tool such as a nipper at the time of sorting. This holds promise for promoting recycling activities.

The high-height cylindrical portion 70 will be described in detail.

As shown in FIG. 1, the high-height cylindrical portion 70 exists between the jaw portion 34 and the flange portion 36 to connect the jaw portion 34 and the flange portion 36 to each other.

The high-height cylindrical portion 70 as described above preferably has a height (H) of at least 8 mm and more preferably at least 10 mm. The height (H) is also preferably up to 20 mm and more preferably up to 15 mm.

It is preferable for the height (H) of the high-height cylindrical portion 70 to fall within the above-defined range because it is possible to determine more easily that the container is already opened and in addition the cap ring 54 is cut out more easily using a tool such as a nipper at the time of sorting.

Figure 5:
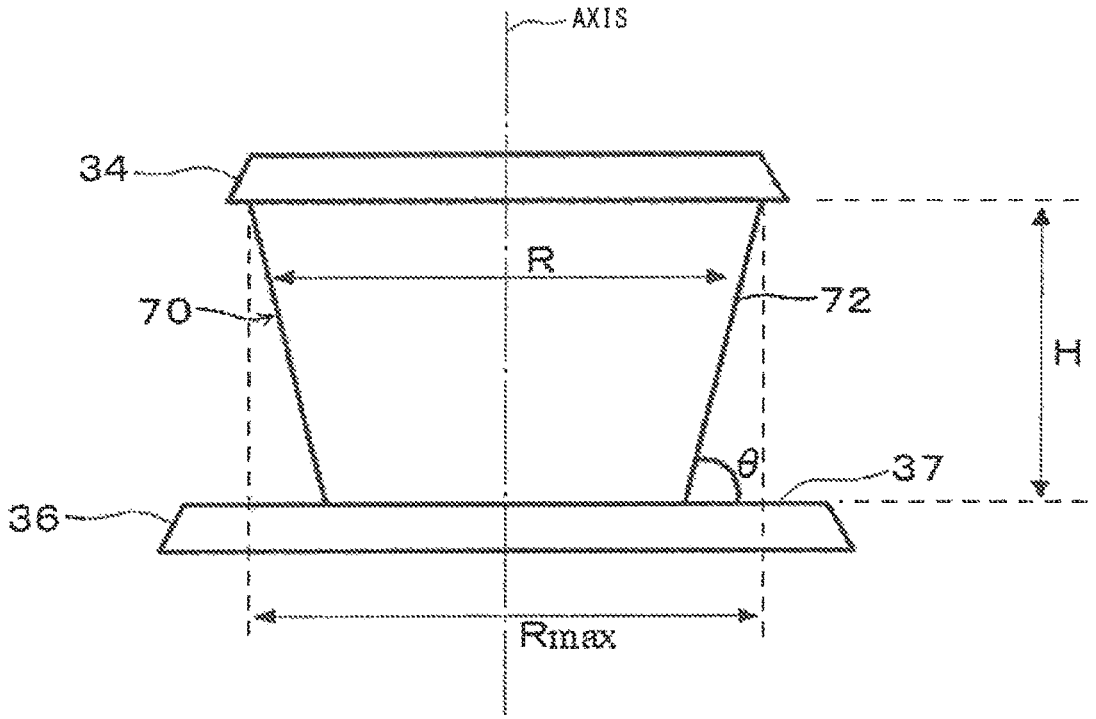
FIG. 5 is a schematic view only showing a jaw portion, a high-height cylindrical portion and a flange portion in the bottle-shaped resin container of the invention shown in FIG. 1.

As shown in FIGS. 1 and 5, the height (H) of the high-height cylindrical portion 70 refers to a length from the lower surface of the jaw portion 34 to an upper surface 37 of the flange portion 36 in the bottle-shaped resin container of the invention disposed so that its axis extends in a vertical direction. FIG. 5 is a schematic view only showing the jaw portion 34, the high-height cylindrical portion 70 and the flange portion 36 in the bottle-shaped resin container of the invention shown in FIG. 1.

The difference (H−h) between the height (H) of the high-height cylindrical portion 70 and the height (h) of the cap ring 54 is preferably at least 3 mm. H−h is preferably at least 4 mm and preferably at least 5 mm. H−h is preferably up to 20 mm, more preferably up to 15 mm, even more preferably up to 10 mm, vet even more preferably up to 8 mm, and still even more preferably up to 6 mm. H−h is preferably from 5 to 6 mm.

It is preferable for the difference (H−h) between the height (H) of the high-height cylindrical portion 70 and the height (h) of the cap ring 54 to fall within the above-defined range because it is possible to determine more easily that the container is already opened and in addition the cap ring 54 is cut out more easily using a tool such as a nipper at the time of sorting.

The height (h) of the cap ring 54 and the height (H) of the high-height cylindrical portion 70 preferably satisfy the relation of $H \geq 1.5 \times h$ and more preferably $H \geq 1.8 \times h$. The height (h) of the cap ring 54 and the height (H) of the high-height cylindrical portion 70 also preferably satisfy the relation of $H \leq 4.0 \times h$, more preferably $H \leq 3.0 \times h$, even more preferably $H \leq 2.5 \times h$, and still even more preferably $H \leq 2.2 \times h$. The height of the high-height cylindrical portion is preferably about twice the height of the cap ring as expressed by $H = 2 \times h$.

It is preferable for the height (h) of the cap ring 54 and the height (H) of the high-height cylindrical portion 70 to satisfy the foregoing relations because it is possible to determine more easily that the container is already opened and in addition the cap ring 54 is cut out more easily using a tool such as a nipper at the time of sorting.

The height (h) of the cap ring 54 refers to a vertical length from the upper surface to the lower surface of the cap ring 54 in the bottle-shaped resin container of the invention disposed so that its axis extends in the vertical direction, as shown in FIG. 1.

The high-height cylindrical portion 70 has a taper angle of up to 90° and preferably a taper angle of 30° or more but less than 90°.

The taper angle is more preferably at least 45°, even more preferably at least 60°, yet even more preferably at least 65°, and still even more preferably at least 81°. The taper angle is also more preferably up to 85°, even more preferably up to 80°, and yet even more preferably up to 75°. The taper angle is preferably about 70°.

It is preferable for the high-height cylindrical portion 70 to have a taper angle within the above-defined range because when the cap main body 52 is rotated in a direction in which the female threaded portion 58 is unscrewed from the male threaded portion 32, thus breaking the bridges 56 to separate the cap ring 54 from the cap main body 52, the cap ring 54 moves smoothly onto the flange portion 36 due to its own weight so that its lower surface comes into contact with the flange portion 36, and hence it is possible to determine more easily that the container is already opened and in addition the cap ring 54 is cut out more easily using a tool such as a nipper at the time of sorting.

The taper angle of the high-height cylindrical portion 70 will be described with reference to FIG. 5.

As described above, FIG. 5 is a schematic view only showing the jaw portion 34, the high-height cylindrical portion 70 and the flange portion 36 in the bottle-shaped resin container of the invention shown in FIG.

The taper angle of the high-height cylindrical portion 70 means an angle indicated by θ in FIG. 5. More specifically, the taper angle means an angle formed between a lateral surface 72 of the high-height cylindrical portion 70 and the upper surface 37 of the flange portion 36 when seen from the front of the bottle-shaped resin container of the invention disposed so that its axis extends in the vertical direction.

If the taper angle cannot be determined unambiguously as in a case where the high-height cylindrical portion 70 has more than one lateral surface 72 or in a case where the lateral surface 72 is a curved surface, the taper angle means a maximum value of the angle formed between the lateral surface 72 of the high-height cylindrical portion 70 and the upper surface 37 of the flange portion 36.

The shape of the lateral surface 72 of the high-height cylindrical portion 70 will be described with reference to FIGS. 6 to 11. FIGS. 6 to 11 are each a partially enlarged schematic view (cross-sectional view) of the cap ring 54, the stopper 60, the jaw portion 34, the high-height cylindrical portion 70 and the flange portion 36. The cap ring 54 usually has burrs 76 formed on its upper side.

Figure 6:
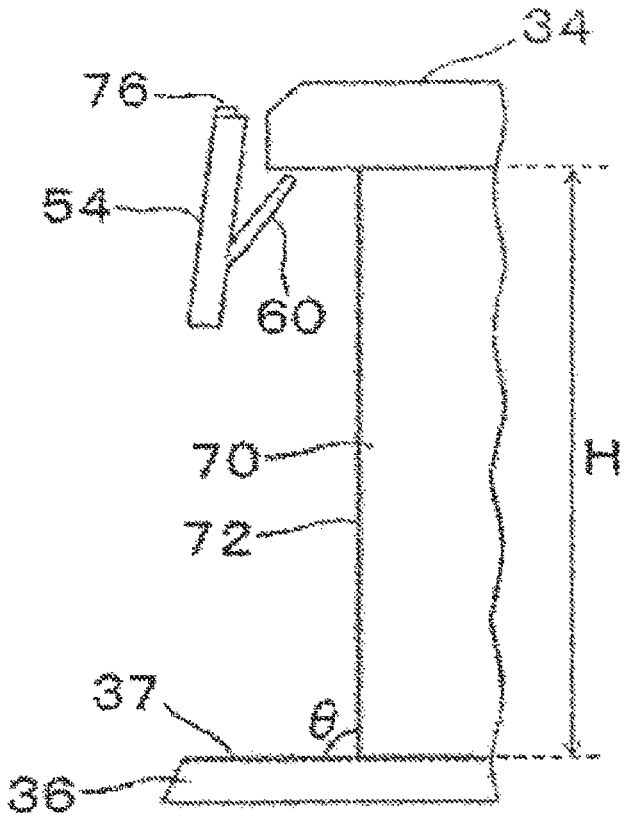
FIG. 6 is a schematic enlarged view (cross-sectional view) for illustrating an embodiment of a lateral surface of the high-height cylindrical portion.

The embodiment shown in FIG. 6 is the same as the embodiment shown in FIGS. 1 and 5 in that the lateral surface of the high-height cylindrical portion 70 has a linear profile when seen from the front but the taper angle (i.e., the angle (θ) formed between the lateral surface and the upper surface 37 of the flange portion 36) is different. To be more specific, the taper angle in the embodiment shown in FIGS. 1 and 5 is less than 90° but the taper angle in the embodiment shown in FIG. 6 is 90°.

The high-height cylindrical portion in the bottle-shaped resin container according to the invention is preferably of the embodiment shown in FIG. 6 because it is easy to manufacture the cylindrical portion owing to its simple shape. The stopper 60 is preferably located at a position where the stopper 60 does not easily come into contact with the lateral surface 72 of the high-height cylindrical portion 70 because the cap ring 54 drops down easily due to its own weight.

Figure 7:
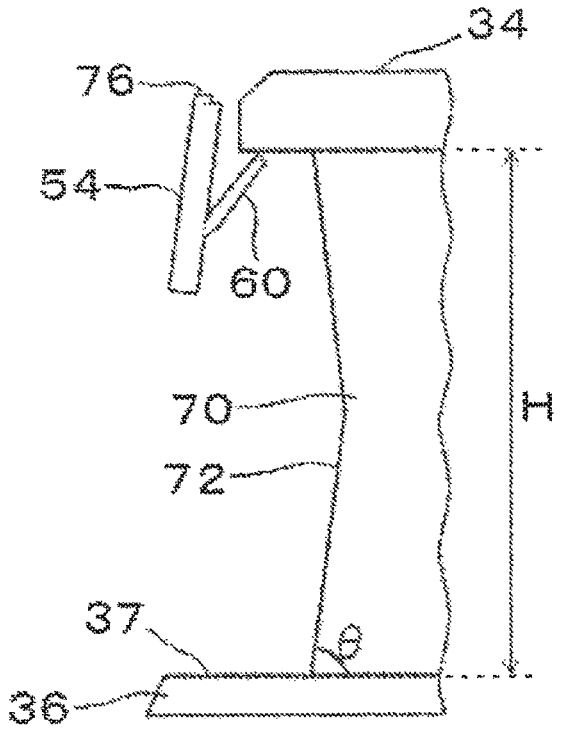
FIG. 7 is a schematic enlarged view (cross-sectional view) for illustrating another embodiment of the lateral surface of the high-height cylindrical portion.
Figure 8:
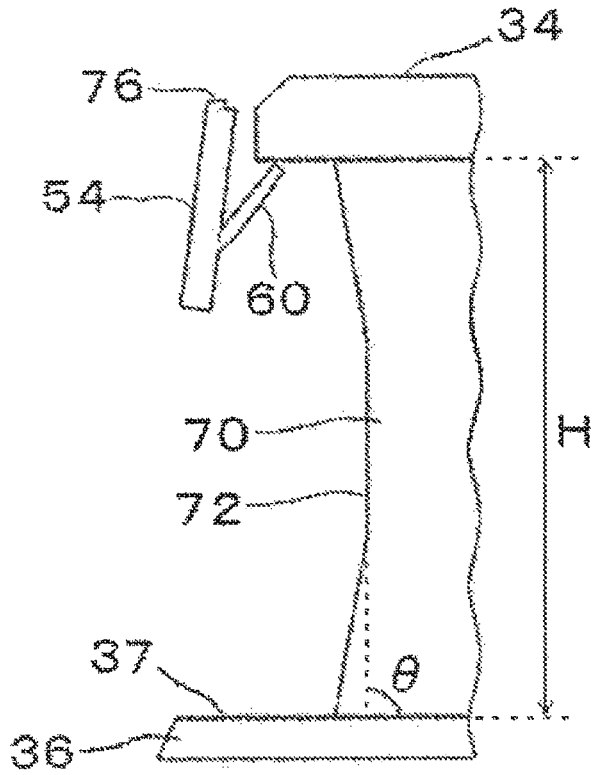
FIG. 8 is a schematic enlarged view (cross-sectional view) for illustrating still another embodiment of the lateral surface of the high-height cylindrical portion.

The embodiments shown in FIGS. 7 and 8 are embodiments in each of which the lateral surface 72 of the high-height cylindrical portion 70 has a profile of straight lines (two straight lines in the embodiment shown in FIG. 7 and three straight lines in the embodiment shown in FIG. 8) when seen from the front and the central portion in its height direction is inwardly concave.

The high-height cylindrical portion in the bottle-shaped resin container according to the invention is preferably of the embodiment shown in FIG. 7 or FIG. 8 because the high-height cylindrical portion has a higher strength.

In this case, the taper angle means angles indicated by θ in FIGS. 7 and 8.

Figure 9:
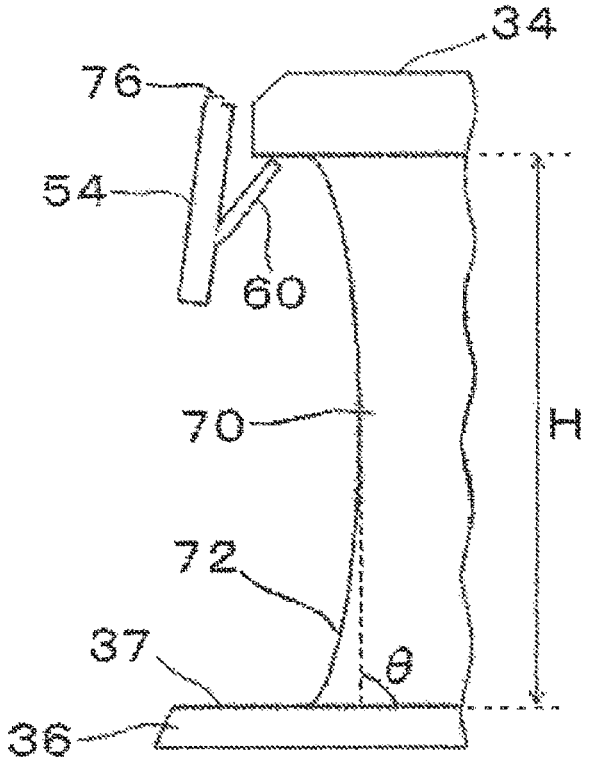
FIG. 9 is a schematic enlarged view (cross-sectional view) for illustrating vet another embodiment of the lateral surface of the high-height cylindrical portion.

The embodiment shown in FIG. 9 is an embodiment in which the lateral surface 72 of the high-height cylindrical portion 70 has a curved profile when seen from the front.

The high-height cylindrical portion in the bottle-shaped resin container according to the invention is preferably of the embodiment shown in FIG. 9 because the high-height cylindrical portion has a higher strength.

In this case, the taper angle means an angle indicated by θ in FIG. 9.

Figure 10:
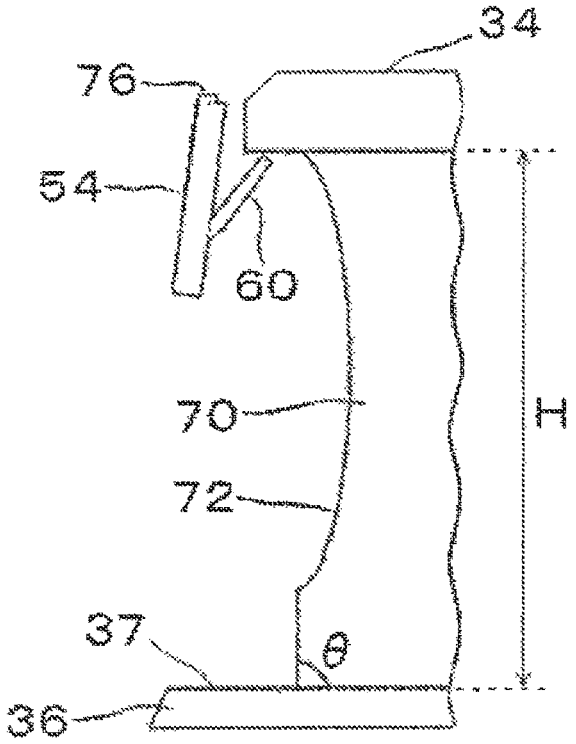
FIG. 10 is a schematic enlarged view (cross-sectional view) for illustrating still yet another embodiment of the lateral surface of the high-height cylindrical portion.

The embodiment shown in FIG. 10 is an embodiment in which the lateral surface 72 of the high-height cylindrical portion 70 has a profile composed of a combination of a curved portion and a linear portion when seen from the front.

The high-height cylindrical portion in the bottle-shaped resin container according to the invention is preferably of the embodiment shown in FIG. 10 because the high-height cylindrical portion has a higher strength.

In this case, the taper angle means an angle indicated by 9 in FIG. 10.

Figure 11:
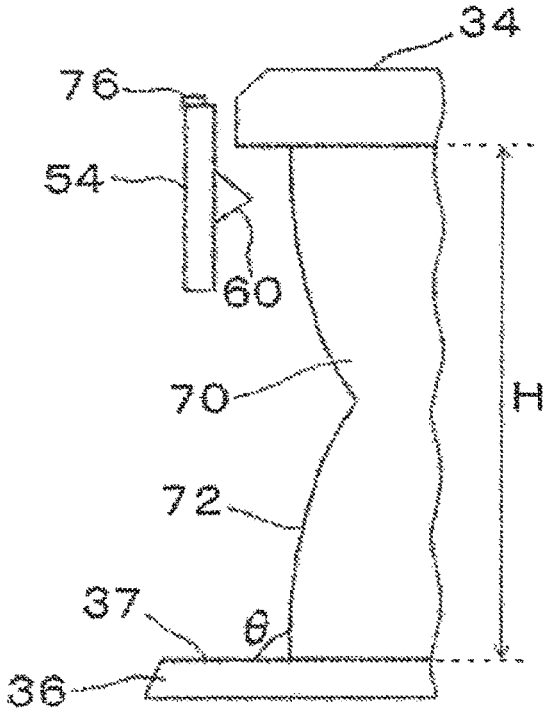
FIG. 11 is a schematic enlarged view (cross-sectional view) for illustrating vet still another embodiment of the lateral surface of the high-height cylindrical portion.

The embodiment shown in FIG. 11 is an embodiment in which the lateral surface 72 of the high-height cylindrical portion 70 has a profile of curved lines (two curved lines in FIG. 11) when seen from the front and the central portion in its height direction is inwardly concave.

In a case where the high-height cylindrical portion in the bottle-shaped resin container of the invention is of the embodiment shown in FIG. 11, the stopper 60 is preferably located at a position where the stopper 60 does not easily come into contact with the lateral surface 72 of the high-height cylindrical portion 70 because the cap ring 54 drops down easily due to its own weight.

In this case, the taper angle means an angle indicated by θ in FIG. 11.

The internal diameter (r) formed by the stopper 60 in the cap ring. 54 and the maximum value ($R_{max}$) of the external diameter (R) of the high-height cylindrical portion 70 preferably satisfy the relation of $0.8 \times r \geq R_{max}$, more preferably $0.9 \times r \geq R_{max}$, even more preferably $0.95 \times r \geq R_{max}$, and still even more preferably $0.98 \times r \geq R_{max}$. The internal diameter (r) formed by the stopper 60 in the cap ring 54 and the maximum value ($R_{max}$) of the external diameter (R) of the high-height cylindrical portion 70 also preferably satisfy the relation of $0.995 \times r \leq R_{max}$, and more preferably $0.99 \times r \leq R_{max}$.

The internal diameter (r) formed by the stopper 60 in the cap ring 54 and the maximum value ($R_{max}$) of the external diameter (R) of the high-height cylindrical portion 70 preferably satisfy the relation of $0.8 \times r \leq R_{max}$, more preferably $0.9 \times r \leq R_{max}$, even more preferably $0.95 \times r \leq R_{max}$, and still even more preferably $0.98 \times r \leq R_{max}$. The internal diameter (r) formed by the stopper 60 in the cap ring 54 and the maximum value ($R_{max}$) of the external diameter (R) of the high-height cylindrical portion 70 also preferably satisfy the relation of $0.995 \times r \geq R_{max}$, and more preferably $0.99 \times r \geq R_{max}$.

It is preferable for the internal diameter (r) formed by the stopper 60 in the cap ring 54 and the maximum value ($R_{max}$) of the external diameter (R) of the high-height cylindrical portion 70 to satisfy such relations because when the cap main body 52 is rotated in a direction in which the female threaded portion 58 is unscrewed from the male threaded portion 32, thus breaking the bridges 56 to separate the cap ring 54 from the cap main body 52 the cap ring 54 moves smoothly onto the flange portion 36 due to its own weight so that its lower surface comes into contact with the flange portion 36, and hence it is possible to determine more easily that the container is already opened and in addition the cap ring 54 is cut out more easily using a tool such as a nipper at the time of sorting.

The maximum value ($R_{max}$) of the external diameter (R) of the high-height cylindrical portion 70 will be described with reference to FIG. 5.

As shown in FIG. 5, the external diameter (R) of the high-height cylindrical portion 70 refers to a horizontal length of the high-height cylindrical portion 70 when seen from the front of the bottle-shaped resin container of the invention disposed so that its axis extends in the vertical direction and its maximum value is denoted by $R_{max}$.

The internal diameter (r) formed by the stopper 60 in the cap ring 54 will be described with reference to FIGS. 12 to 15. FIGS. 12 to 15 are schematic views each showing the top surface or the cross-sectional surface of a cap ring having a typical shape. In each of these drawings, (*a*) is a top view and (*b*) is a cross-sectional view taken along line A-A in (*a*).

Figure 12:
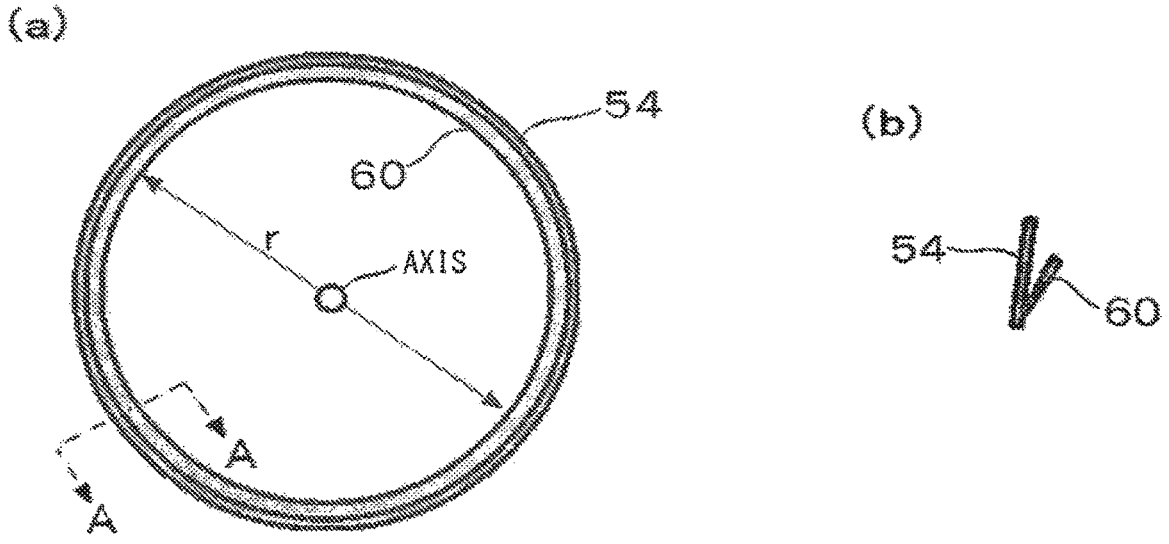
FIG. 12 are schematic views showing the top surface and the cross-sectional surface of a cap ring having a typical shape.

FIG. 12 show an embodiment in which one stopper 60 which is capable of engagement with the lower end of the jaw portion 34 from below is formed inside the ring-shaped cap ring 54 along the inner periphery of the cap ring 54. The stopper 60 is formed to project in a direction toward the axis.

In such an embodiment, the internal diameter (r) formed by the stopper 60 in the cap ring 54 means a length shown in FIG. 12(*a*).

Figure 13:
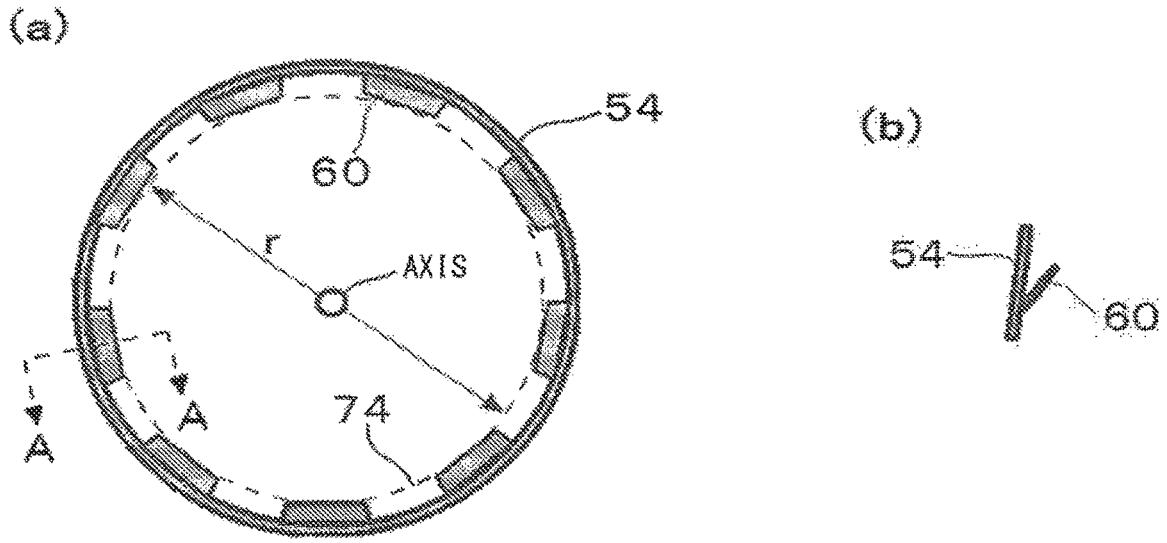
FIG. 13 are schematic views showing the top surface and the cross-sectional surface of another cap ring having a typical shape.

FIG. 13 show an embodiment in which a plurality of stoppers 60 which are capable of engagement with the lower end of the jaw portion 34 from below are formed inside the ring-shaped cap ring 54 in a circumferential direction at a predetermined pitch so as to project in a direction toward the axis.

In such an embodiment, the internal diameter (r) formed by the stoppers 60 in the cap ring 54 means a diameter of an inscribed circle 74 (circle indicated by a dotted line in FIG. 13(*a*)) drawn so as to contact all the stoppers 60 in FIG. 13(*a*).

Figure 14:
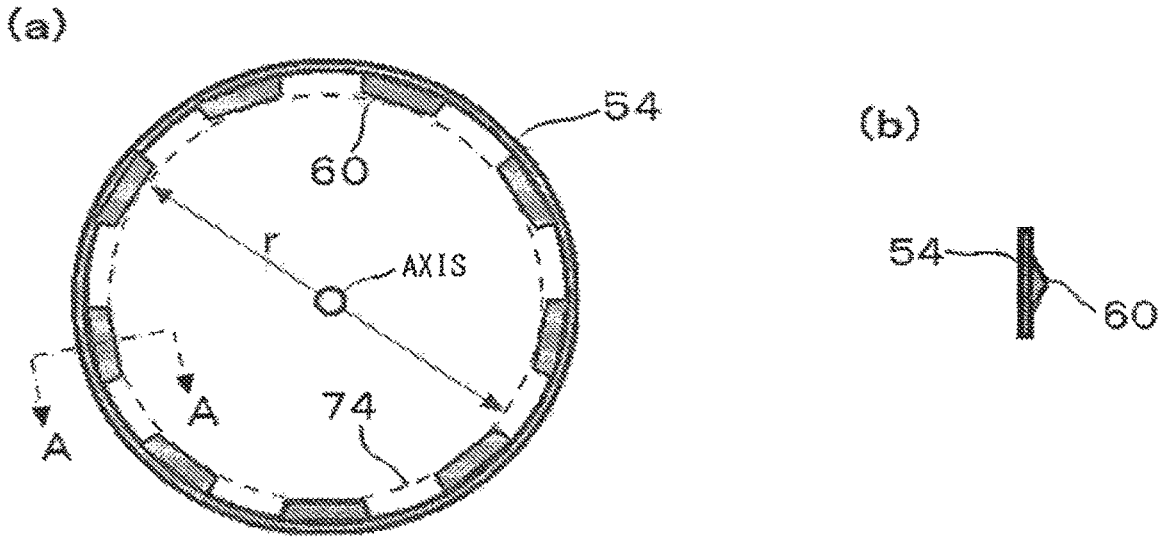
FIG. 14 are schematic views showing the top surface and the cross-sectional surface of still another cap ring having a typical shape.
Figure 15:
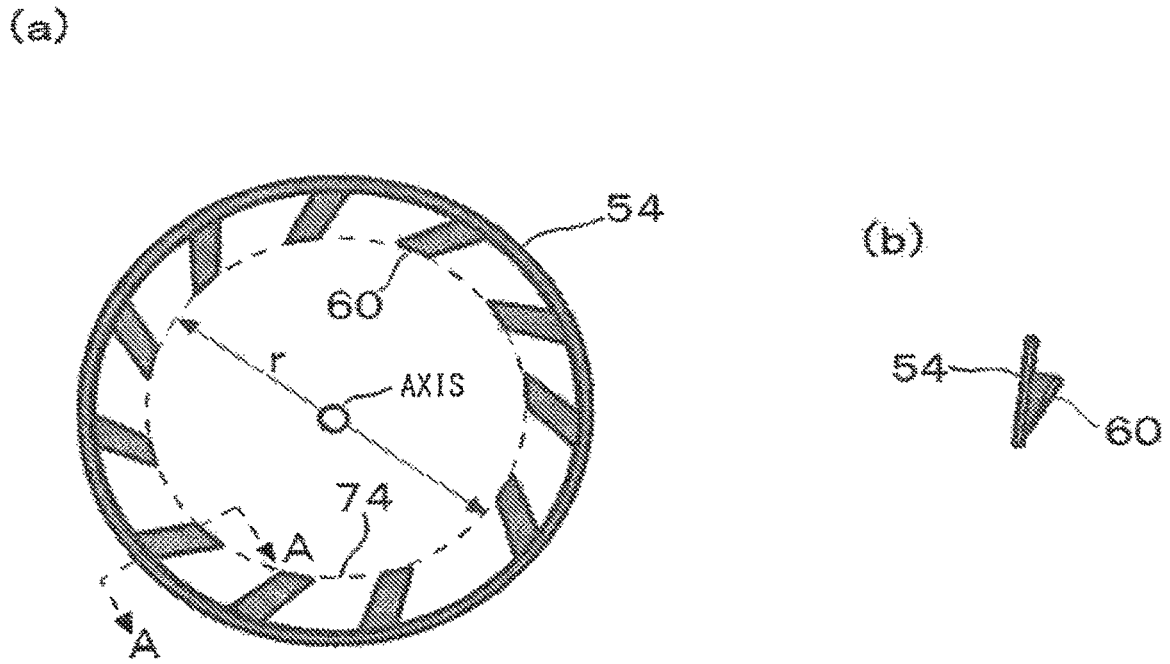
FIG. 15 are schematic views showing the top surface and the cross-sectional surface of yet another cap ring having a typical shape.

The embodiments shown in FIGS. 14 and 15 are different from the embodiments shown in FIGS. 12 and 13 but as in the embodiment shown in FIGS. 13, the internal diameter (r) formed by stoppers 60 in the cap ring 54 means a diameter of an inscribed circle 74 drawn so as to contact all the stoppers 60 in each of FIGS. 14(*a*) and 15(*a*).

Next, the positional relation between the cap ring 54 and the jaw portion 54 and the positional relation between the stopper 60 and the high-height cylindrical portion 70 will be described with reference to FIGS. 16 to 19.

Figure 16:
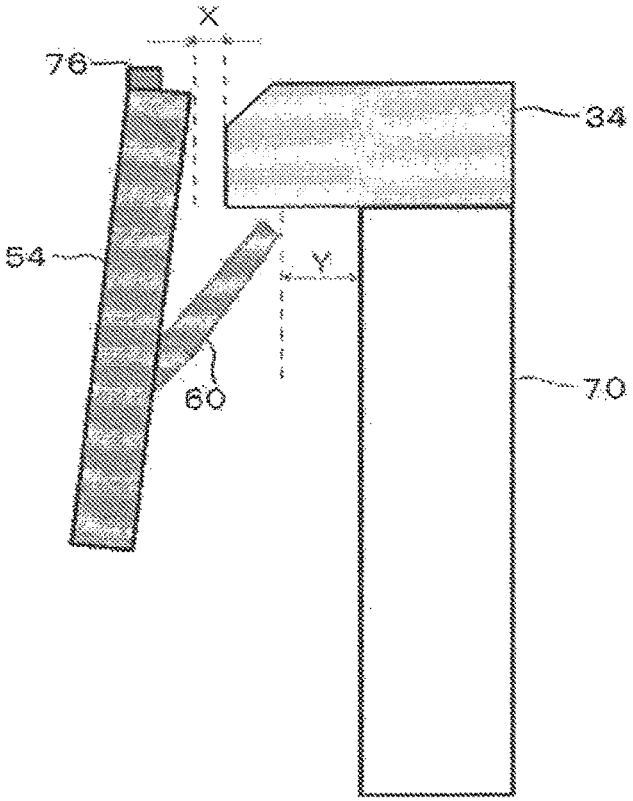
FIG. 16 is a schematic enlarged view (cross-sectional view) of the periphery of a cap ring and a stopper.

FIG. 16 is an enlarged schematic view (cross-sectional view) showing the vicinity of the cap ring 54 and the stopper 60 in FIG. 1.

As described above, the cap ring 54 is formed so as so have a slightly larger internal diameter than the external diameter of the jaw portion 34 so that the cap ring 54 is fitted on the outside of the jaw portion 34 with a slight gap formed outside the jaw portion 34.

To be more specific, the horizontal distance (X) between the inner end of the cap ring 54 (end closest to the axis) and the outer end of the jaw portion 34 (end farthest from the axis) as shown in FIG. 16 is preferably at least 0.2 mm and more preferably at least 0.25 mm. The distance (X) is also preferably up to 3 mm, more preferably up to 1 mm, and even more preferably up to 0.5 mm.

When the cap main body 52 is rotated in a direction in which the female threaded portion 58 is unscrewed from the male threaded portion 32, thereby breaking the bridges 56 to discharge content 62 such as drinking water from the bottle main body 3, burrs 76 usually remain at the upper end portion of the cap ring 54 as shown in FIG. 16. The distance (X) is preferably within the above-defined range because when the cap ring 54 separated from the cap main body 52 moves onto the flange portion 36 due to its own weight, the burrs 76 are not easily caught on the jaw portion 34 and hence the cap ring 54 moves smoothly.

The horizontal distance (Y) between the inner end of the stopper 60 (end closest to the axis) and the outer end of the high-height cylindrical portion 70 (end farthest from the axis) as shown in FIG. 16 is preferably at least 0.2 mm and more preferably at least 0.25 mm. The distance (F) is also preferably up to 3 mm, more preferably up to 1 mm, and even more preferably up to 0.5 mm.

The distance (Y) is preferably within the above-defined range because when the cap ring 54 separated from the cap main body 52 moves onto the flange portion 36 due to its own weight, the stopper 60 is not easily caught on the lateral surface of the high-height cylindrical portion 70 and hence the cap ring 54 moves smoothly.

Figure 17:
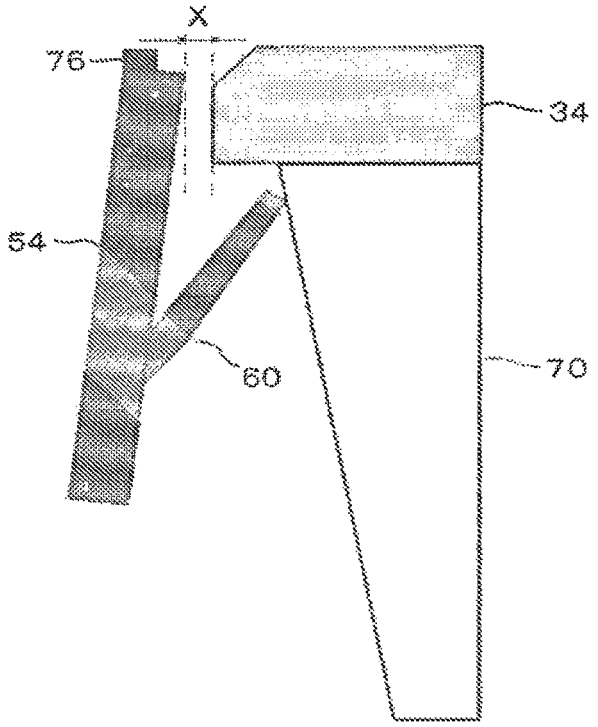
FIG. 17 is a schematic enlarged view (cross-sectional view) of the periphery of another cap ring and another stopper.

The embodiment shown in FIG. 17 is different from the embodiment shown in FIG. 16 in that the high-height cylindrical portion 70 has a taper angle of 30° or more but less than 90°.

Such a case is preferable because even if the distance (F) shown in FIG. 16 is substantially zero as shown in FIG. 17, when the cap ring 54 separated from the cap main body 52 moves onto the flange portion 36 due to its own weight, the stopper 60 is not easily caught on the lateral surface of the high-height cylindrical portion 70 and hence the cap ring 54 moves smoothly.

Figure 18:
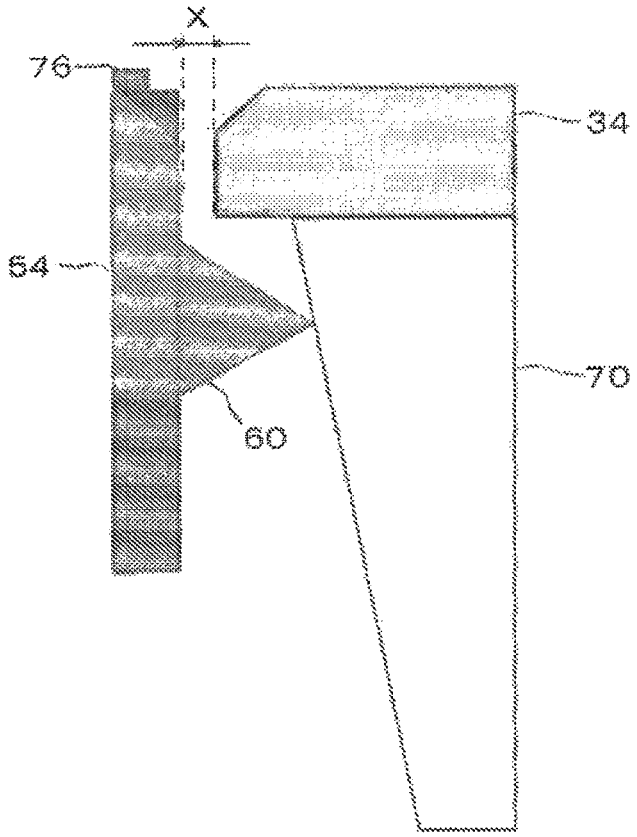
FIG. 18 is a schematic enlarged view (cross-sectional view) of the periphery of still another cap ring and still another stopper.

The embodiment shown in FIG. 18 is different from the embodiment shown in FIG. 17 in the shape of the stopper 60.

Even such a case is preferable as long as the high-height cylindrical portion 70 has a taper angle of 30° or more but less than 90° as in the embodiment shown in FIG. 17 because even if the distance (Y) shown in FIG. 16 is substantially zero as shown in FIG. 16, when the cap ring 54 separated from the cap main body 52 moves onto the flange portion 36 due to its own weight, the stopper 60 is not easily caught on the lateral surface of the high-height cylindrical portion 70 and hence the cap ring 54 moves smoothly.

Figure 19:
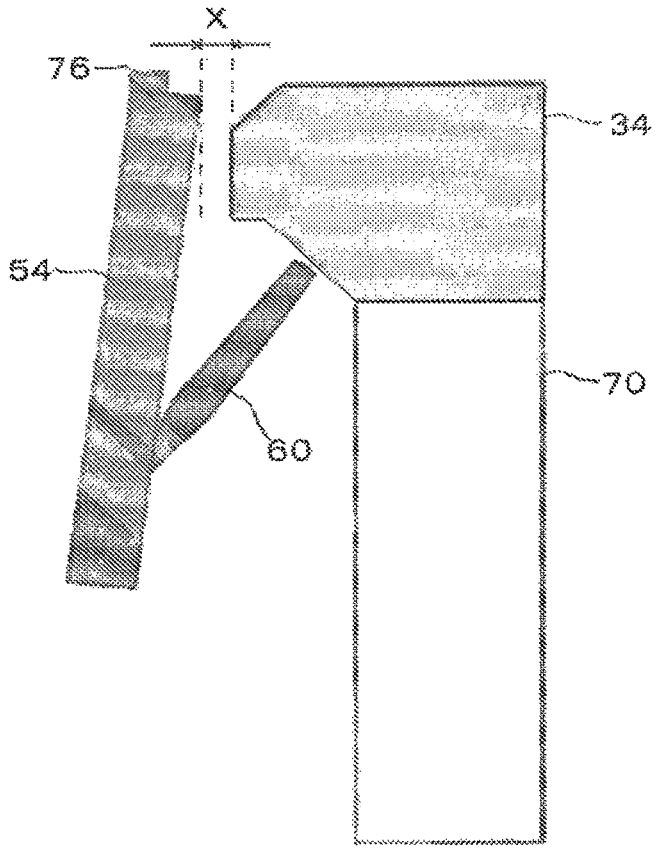
FIG. 19 is a schematic enlarged view (cross-sectional view) of the periphery of yet another cap ring and yet another stopper.

The embodiment shown in FIG. 19 is different from the embodiment shown in FIG. 16 in the shape of the lower surface of the jaw portion 34. Such a shape is preferable because even if the high-height cylindrical portion 70 has no taper angle (the taper angle is 90°) and the distance (Y) shown in FIG. 16 is substantially zero as shown in FIG. 19, when the cap ring 54 separated from the cap main body 52 moves onto the flange portion 36 due to its own weight, the stopper 60 is not easily caught on the lateral surface of the high-height cylindrical portion 70 and hence the cap ring 54 moves smoothly.

Next, the positions of the bridges in the cap ring will be described with reference to FIGS. 20.

Figure 20:
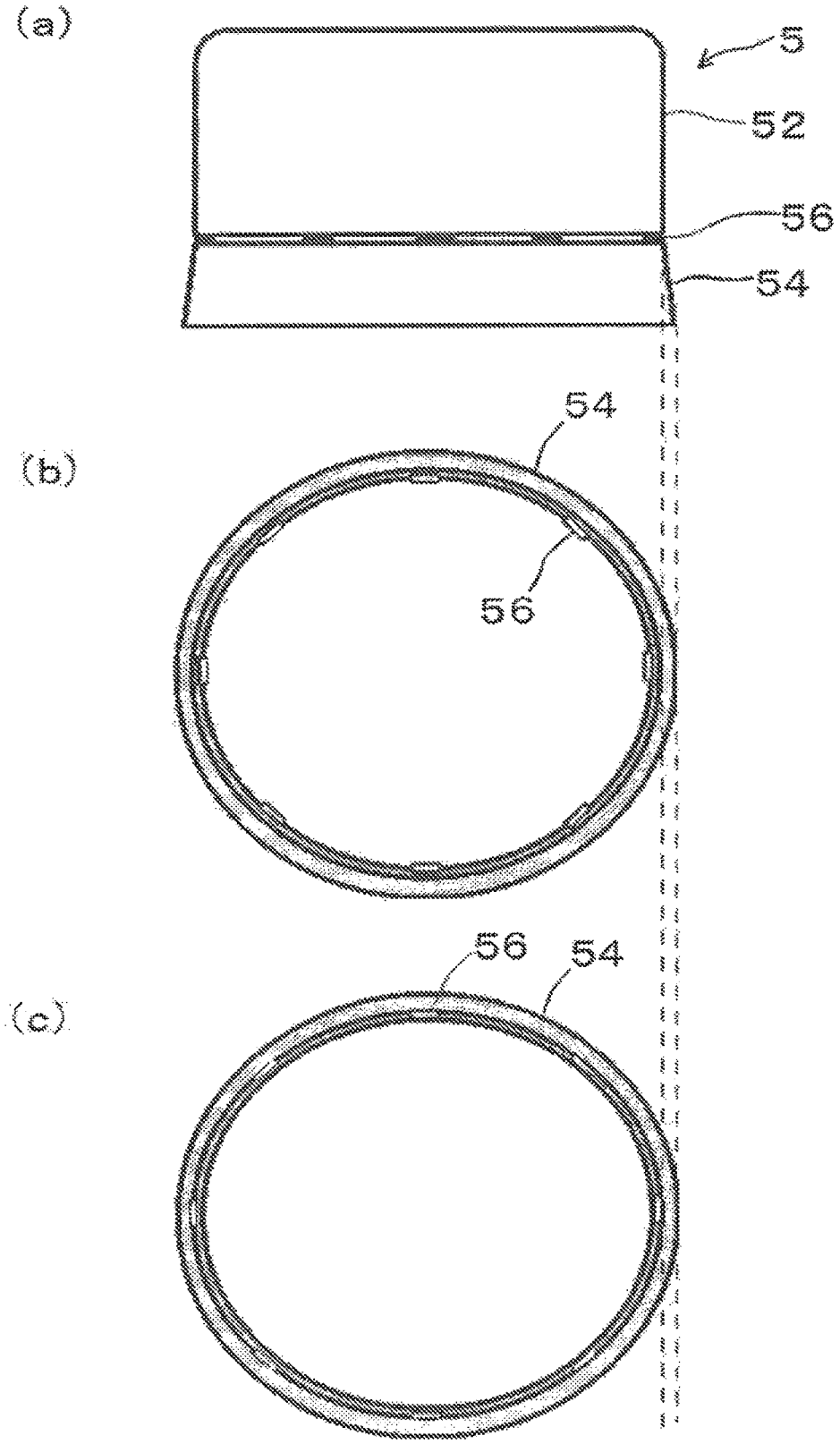
FIG. 20 are schematic views for illustrating the positional relation between a cap ring and bridges.

FIG. 20(*a*) is a schematic front view of the cap 5 including the cap main body 52, the cap ring 54 and the bridges 56 connecting the cap main body 52 and the cap ring 54 to each other. FIGS. 20(*b*) and 20(*c*) are views (schematic views) of the cap ring 54 when seen from above. FIG. 20(*b*) is different from FIG. 20(*c*) in the positions of the bridges 56. The bridges 56 in FIG. 20(*b*) are formed on the inner peripheral side in the thickness direction of the cap ring 54, whereas the bridges 56 in FIG. 20(*c*) are formed on the outer peripheral side in the thickness direction of the cap ring 54.

In the bottle-shaped resin container of the invention, the bridges 56 are preferably formed on the outer peripheral side in the thickness direction of the cap ring 54 as shown in FIG. 20(*c*). The bridges 56 are preferably located at positions where burrs and the like are not easily caught on the lateral surface of the high-height cylindrical portion 70 when the cap ring 54 moves onto the flange portion 36 and are therefore preferably not located on the inner peripheral side in the thickness direction of the cap ring 54. However, the bridges 56 may be located on the inner peripheral side if burrs and the like are not easily caught on the lateral surface of the high-height cylindrical portion 70 even in the presence of the bridges 56 on the inner peripheral side in the thickness direction of the cap ring 54 when the cap ring 54 moves onto the flange portion 36, as in a case where the bridges 56 are small in size.

As described above, wham the cap main body is rotated in a direction in which the female threaded portion is unscrewed from the male threaded portion, thereby breaking the bridges to discharge content such as drinking water from the bottle main body, burrs usually remain at the upper end portion of the cap ring 54. The bridges 56 are preferably formed on the outer Peripheral side in the thickness direction of the cap ring 54 as shown in FIG. 20(*c*) because when the cap ring 54 separated from the cap main body moves onto the flange portion due to its own weight, the burrs are not easily caught on the jaw portion and hence the cap ring 54 moves smoothly.

Figure 21:
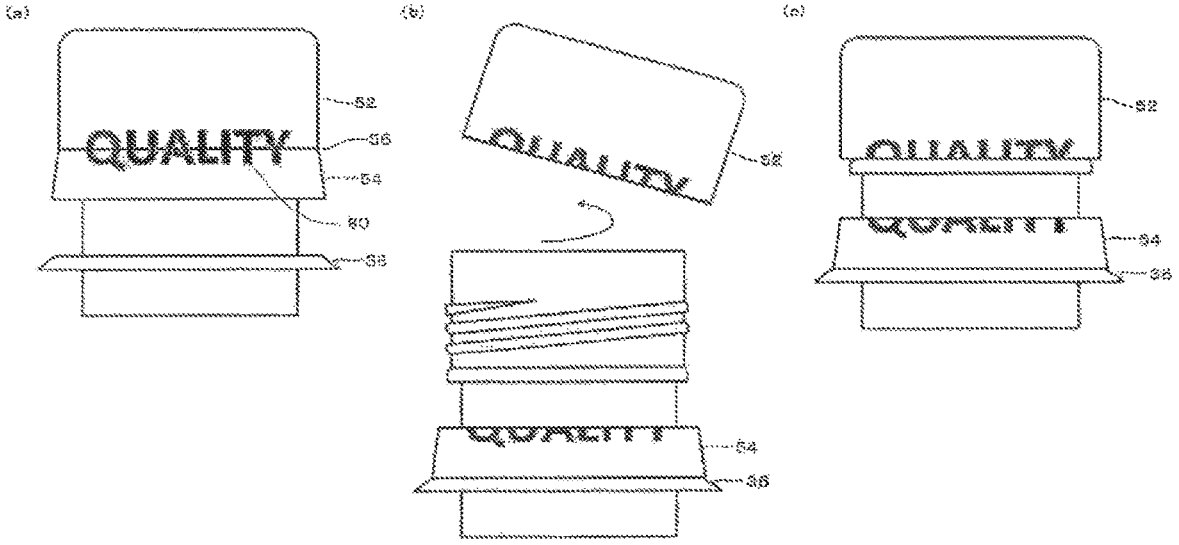
FIG. 21 are schematic front views for illustrating marking.

The bottle-shaped resin container 1 of the invention is preferably configured such that a marking 80 is formed on the surfaces of the cap main body 52 and the cap ring 54 so as to lie on both the cap main body 52 and the cap ring 54 in a state in which the cap 5 is not opened, and the cap main body 52 and the cap ring 54 are connected to each other via the bridges 56 as shown in FIG. 21(*a*) and the bridges 56 are broken by cap opening to cause the cap ring 54 separated from the cap main body 52 to move onto the flange portion 36 due to its own weight as shown in FIG. 21(*b*), which makes it possible to determine that the cap is already opened because in a case where the cap 5 is closed again, the marking 80 is not restored to the same state as before the cap opening, as shown in FIG. 21(*c*).

Figure 22:
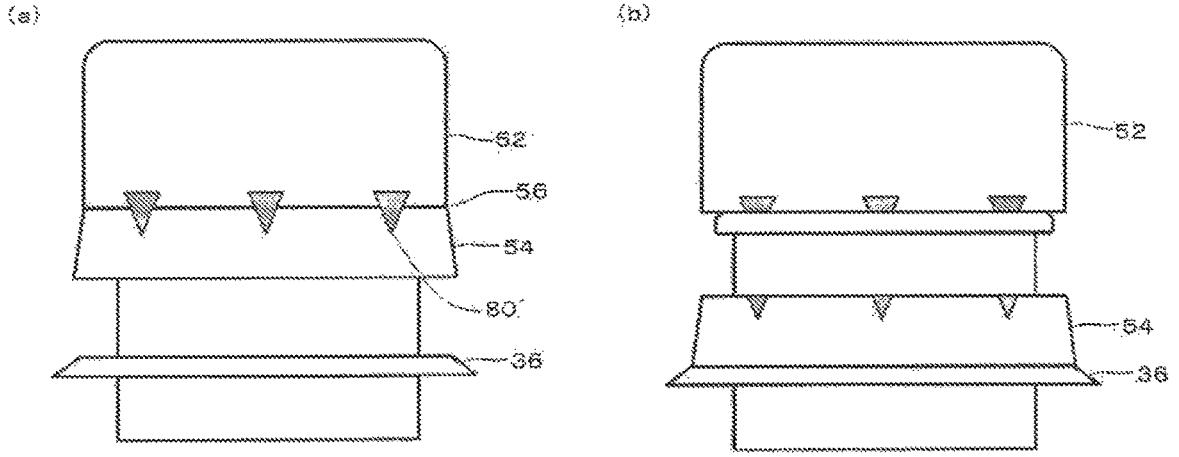
FIG. 22 are schematic front views for illustrating another marking.
Figure 23:
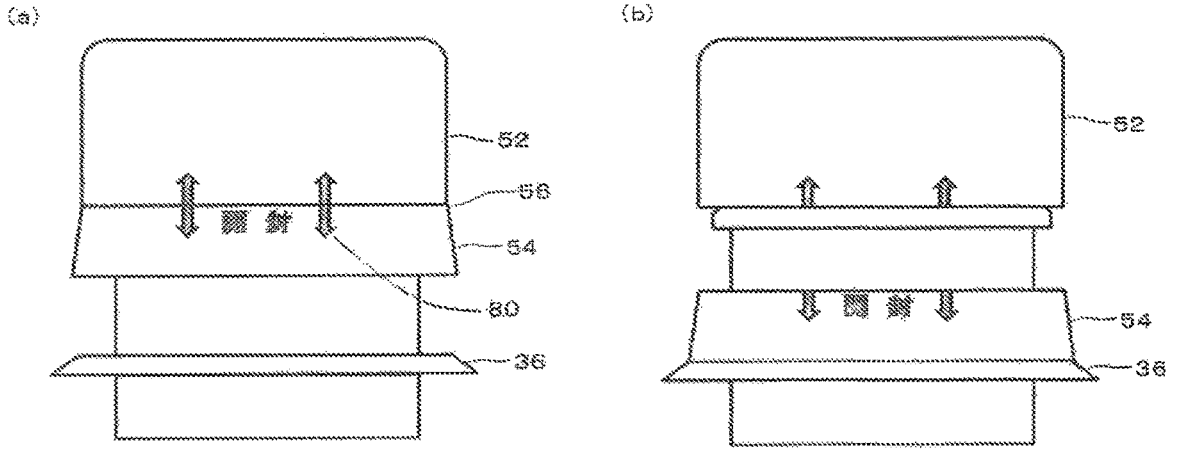
FIG. 23 are schematic front views for illustrating still another marking.
Figure 24:
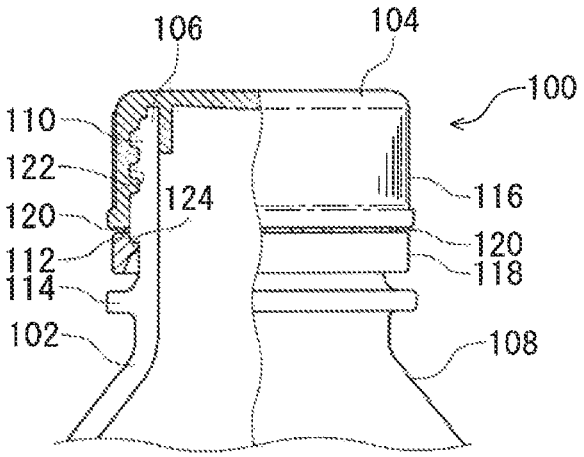
FIG. 24 is a schematic partial front view (partial cross-sectional view) for illustrating a conventional bottle-shaped resin container.
Figure 25:
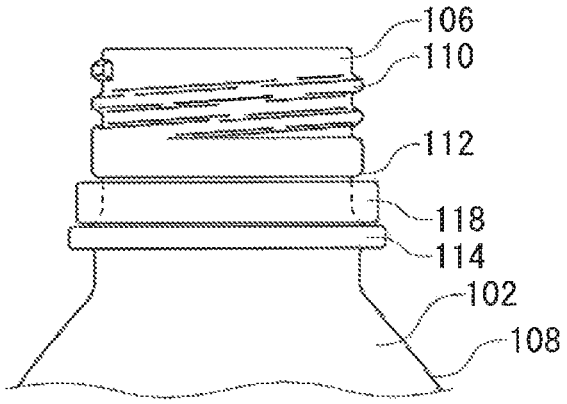
FIG. 25 is another schematic partial front view for illustrating the conventional bottle-shaped resin container.

The marking 80 may be composed of letters such as "QUALITY" as shown in FIGS. 21, figures (80') as shown in FIG. 22, or a combination of figures and letters (80") as shown in FIGS. 23.

The markings (80, 80', 80") may be formed by any of marking methods including printing, coloring and embossing to make a relief.

DESCRIPTION OF SYMBOLS

1 bottle-shaped resin container
3 beetle main body
5 cap
30 neck portion
32 male threaded portion
34 jaw portion
36 flange portion
37 upper surface of the flange portion
40 body portion
52 cap main body
54 cap ring
56 bridge
58 female threaded portion
60 stopper
62 content
70 high-height cylindrical portion
72 lateral surface of the high-height cylindrical portion
74 circle inscribed in stoppers
76 burr
80, 80', 80" markings
100 bottle-shaped resin container
102 bottle main body
104 cap
106 neck portion
108 body portion
110 male threaded portion
112 jaw portion
114 flange portion
116 cap main body
118 cap ring
120 bridge
122 female threaded portion
124 stopper

The invention claimed is:

1. A bottle-shaped resin container comprising:

a bottle main body including a neck portion and a body portion which are integrally formed, the neck portion having, on an outer periphery of the neck portion, a male threaded portion as well as an annular jaw portion and an annular flange portion each forming a horizontally projecting portion, the male threaded portion, the jaw portion and the flange portion being formed downward from above in this order; and a cap including a cap main body, a cap ring, and at least one bridge connecting the cap main body and the cap ring to each other, the cap main body including a female threaded portion formed on an inner periphery of the cap main body and configured to be screwed onto the male threaded portion such that the female threaded portion is screwed onto the male threaded portion to allow the cap to close the neck portion, wherein:

the cap ring is in a ring shape, an upper end of the cap ring is connected to a lower end of the cap main body via the at least one bridge, the cap ring being formed to have a larger internal diameter than an external diameter of the jaw portion so that the cap ring is fitted on the jaw portion with a gap formed outside the jaw portion;

at least one stopper configured to engage with a lower end of the jaw portion from below is formed inside the cap ring so as to project in a direction toward an axis such that when the cap is screwed onto the neck portion after filling the bottle main body with content, an upper end of the at least one stopper is engaged with a lower surface of the jaw portion after the at least one stopper passes around the jaw portion;

a high-height cylindrical portion connecting the jaw portion and the flange portion to each other is provided between the jaw portion and the flange portion;

the high-height cylindrical portion has a height (H) of 10 to 20 mm, and when seen from a front, the high-height cylindrical portion has a lateral surface of a curved profile which is inwardly convex, the lateral surface extending in a circumferential direction from the jaw portion to the flange portion, the lateral surface being flat around an entire circumference of the high-height cylindrical portion in the circumferential direction, the lateral surface having a profile composed of (i) a combination of a curved portion which is inwardly convex with a linear portion, or (ii) curved lines that respectively concave inwardly from each upper edge and lower edge of the lateral surface in the vertical direction, a central portion in a vertical direction of the lateral surface being inwardly concave;

the at least one bridge is formed on an outer peripheral side of the cap ring; and when the cap main body is rotated in a direction in which the female threaded portion is unscrewed from the male threaded portion, thus discharging the content from the bottle main body, the at least one bridge is broken by shear force to separate the cap ring from the cap main body, and as a result the cap ring drops down due to a weight of the cap ring in a state in which the axis extends in a vertical direction so that a lower surface of the cap ring comes into contact with the flange portion, the cap ring remains on the flange portion and the lateral surface of the high-height cylindrical portion is exposed between an upper surface of the cap ring and the lower surface of the jaw portion, which makes it possible to determine that the cap is already opened.

2. The bottle-shaped resin container according to claim 1, wherein a difference (H-h) between the height (H) of the high-height cylindrical portion and a height (h) of the cap ring is at least 3 mm.

3. The bottle-shaped resin container according to claim 2, wherein the height (H) of the high-height cylindrical portion and the height (h) of the cap ring satisfy a relation of $H \geq 1.5 \times h$.

4. The bottle-shaped resin container according to claim 2, further comprising a marking formed on surfaces of the cap main body and the cap ring so as to be located on both the cap main body and the cap ring in a state in which the cap is not opened, wherein:

the cap main body and the cap ring are connected to each other via the at least one bridge, and the at least one bridge is broken by the cap opening to cause the cap ring to be separated from the cap main body and drop down to come into contact with the flange portion, which enables determining that the cap is already opened in a case where the cap is closed again due to the marking is not restored to a same state as before the cap opening.

5. The bottle-shaped resin container according to claim 1, wherein the height (H) of the high-height cylindrical portion and a height (h) of the cap ring satisfy a relation of $H \geq 1.5 \times h$.

6. The bottle-shaped resin container according to claim 1, further comprising a marking formed on surfaces of the cap main body and the cap ring so as to be located on both the cap main body and the cap ring in a state in which the cap is not opened, wherein:

the cap main body and the cap ring are connected to each other via the at least one bridge, and the at least one bridge is broken by the cap opening to cause the cap ring to be separated from the cap main body and drop down to come into contact with the flange portion, which enables determining that the cap is already opened in a case where the cap is closed again due to the marking is not restored to a same state as before the cap opening.

* * * * *